United States Patent [19]

Baum

[11] 4,140,170

[45] Feb. 20, 1979

[54] METHOD OF FORMING COMPOSITE MATERIAL CONTAINING SINTERED PARTICLES

[76] Inventor: Charles S. Baum, 34108 Jefferson, Saint Clair Shores, Mich. 48082

[21] Appl. No.: 830,638

[22] Filed: Sep. 6, 1977

[51] Int. Cl.[2] ..... B22D 27/02; B22D 19/08

[52] U.S. Cl. ..... 164/51; 164/80; 164/97; 75/203

[58] Field of Search ..... 164/51, 91, 92, 94, 164/95, 97, 98, 77, 80; 75/200, 203, 204

[56] References Cited

U.S. PATENT DOCUMENTS

| | | | |
|---|---|---|---|
| 1,910,884 | 5/1933 | Comstock | 164/80 |
| 3,258,817 | 7/1966 | Smiley | 164/97 |
| 3,796,564 | 3/1974 | Taylor et al. | 75/200 |

*Primary Examiner*—Richard B. Lazarus
*Assistant Examiner*—K. Y. Lin
*Attorney, Agent, or Firm*—Krass & Young

[57] ABSTRACT

A composite material consisting of particles of a sintered metal-ceramic, supported in a metal matrix is produced by packing a mold with sintered particles having a larger average particle size than those desired in the final composite and particles of the matrix metal. A controlled quantity of heat is then applied to the mass to bring the temperature of the matrix metal above its melting temperature and above the degradation temperature of the sintered particles. The surfaces of the sintered particles in contact with the metal are degradated by de-sintering, diffusion and solution into the molten metal reducing the size of the particles. The heat source is removed before the particles have been reduced in size to their final desired size so that the mass cools and upon solidification the particles have reached their desired final particle size. In the final composite the remaining particles are surrounded by zones of an alloy of the matrix metal and the dissolved constituents of the sintered particles.

19 Claims, 6 Drawing Figures

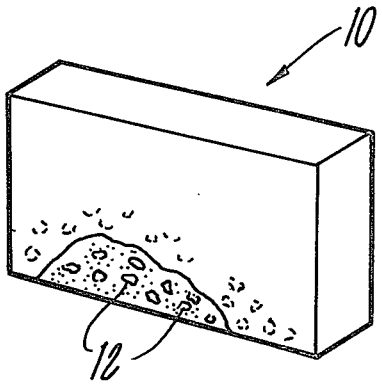
Fig-1
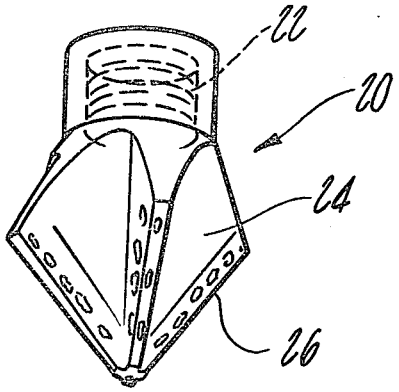
Fig-2
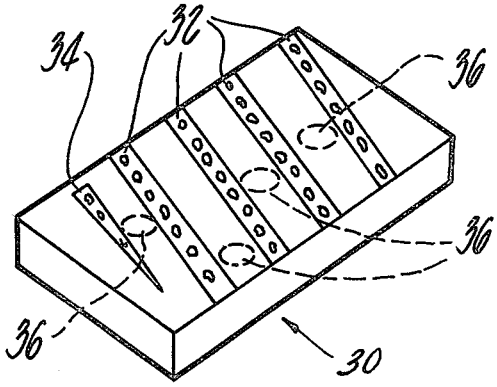
Fig-3
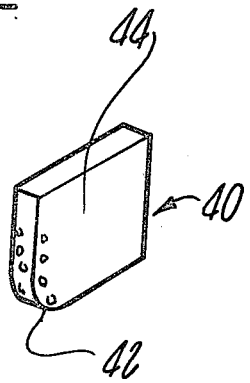
Fig-4
Fig-6
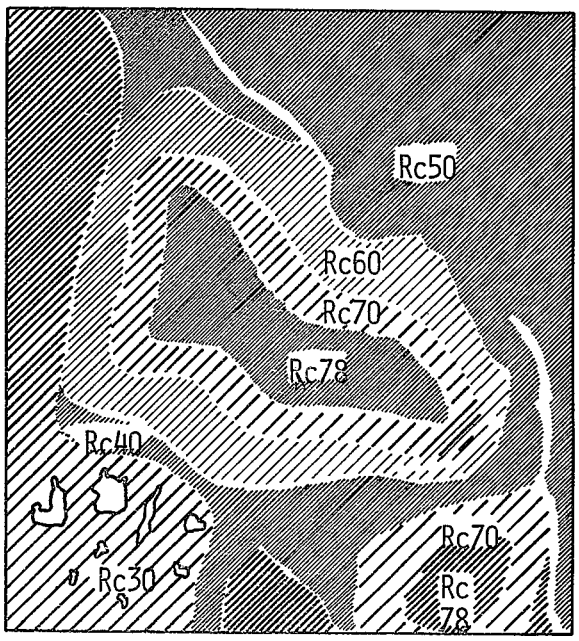
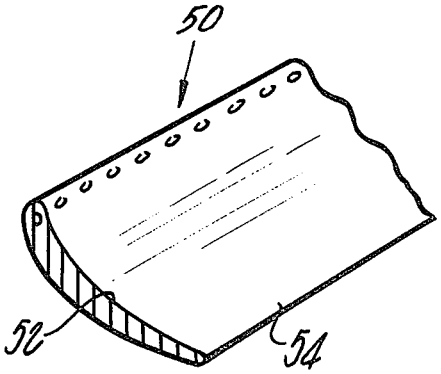
Fig-5

METHOD OF FORMING COMPOSITE MATERIAL CONTAINING SINTERED PARTICLES

BACKGROUND OF THE INVENTION

1. Field of the Invention

This invention relates to methods for producing composite bodies consisting of sintered metal-ceramic particles supported in a metal matrix with the particles surrounded by zones comprising an alloy of the matrix material and dissolved constituents of the particles.

2. Prior Art

My U.S. Pat. No. 4,024,902 discloses a method of forming composite materials consisting of particles of sintered metal-ceramics, in a matrix of steel or like high melting temperature metals. The method involves placing particles of the sintered material in a mold, separately heating the matrix material to above its melting temperature, and then pouring the molten matrixing material into the mold and allowing the mass to naturally cool and solidify. During the period that the molten matrix contacts the sintered particles, the surfaces of the particles are degraded by diffusion and solution of the constituents of the harder material into the matrix. Since the molten metal is at a higher temperature than the original sintering temperature of the particles the portions of the particles at the interface with the hot matrix effectively de-sinter. The quantity and temperature of the molten matrix material and the temperature and geometry of the mold and particles are so chosen that all of the particles will not be totally de-sintered and dissolved into the matrix material before the mass solidifies. The particles will be diminished from their original size but will remain in the finished composite. These particles will be surrounded by zones of a composition of the matrix material, smaller particles and the dissolved constituents of the particles and alloys created by the reaction. In the preferred embodiment of that invention the high temperature material consists of cobalt bound sintered tungsten carbide and the matrixing material a steel alloy. The resultant composite enjoyed a hardness and wear resistance contributed by the tungsten carbide and a toughness contributed by the steel matrix. The diffusion zones surrounding the tungsten carbide particles in the final composite were extremely hard, yet less brittle than the tungsten carbide.

While this process has utility in the formation of a variety of parts, the casting technique imposes certain limitations on the shapes that may be formed. For example, it is extremely difficult to mold in very thin sections without using precision molds and pressure techniques of the type required in an injection molding and it is difficult to form reentrant shapes without using elaborate molds. Also, in some instances the molding process is relatively slow and expensive because of the necessity of forming expendable molds for each part to be formed.

A primary object of the present invention is to provide a method of forming composites having characteristics like those formed by the process of my previous patent, but which avoids the geometric limitations and time and economic restraints of a molding process.

SUMMARY OF THE INVENTION

The present invention is broadly directed toward a method of forming composites employing techniques wherein a particle form of a matrix metal is packed about the sintered particles and the combined mass is then heted above the melting temperature of the matrix metal and above the de-sintering temperature of the sintered particles and the mass is allowed to solidify before the particles have been fully de-sintered, dissolved or diffused into the molten matrix material.

Like my previous molding process for forming composites, this method requires that the quantity of heat introduced into the mass be carefully controlled to control the degree of surface degradation of the sintered particles. Were the process to be allowed to continue for a long period of time at the maximum temperature attained by the molten matrix material, the higher temperature particles might be entirely degraded. This would be undesirable since the characteristics of the composite formed by the method are heavily dependent upon the presence of only partially degraded sintered particles. Accordingly, the process involves terminating the application of thermal energy to the mass after a relatively short period of time and then allowing the mass to naturally cool. The period during which heat is introduced, and the rate of introduction are such that the matrix is allowed to melt and completely wet the surfaces of the higher temperature particles. This wetting involves some solution and/or diffusion of the proximate surfaces of the sintered particles into the molten matrix material and accordingly some degradation of the particle surface and decrease of the original particle size. The heating period may be sufficient to completely degrade some of the smaller particles but the heat introduction is terminated before all of the particles have been fully degraded. The time of termination of the application of heat takes into account that some degradation will occur after termination of the heat.

Heat may be introduced to the mass by passing it through either a controlled or uncontrolled atmosphere furnace or by induction heating. The induction heating may be of the particles while they are disposed in a nonconductive mold or by heating a conductive mold containing the particles.

The exact wetting and particle degradation mechanism will vary depending upon the nature of the sintered particles and of the matrixing metal, but will typically involve solution of some of the components of the hard particles into the matrixing metal, diffusion of some of the components into the matrixing metal and/or the release of nonsuluble islands of the particles into the matrix metal and the migration of these islands away from their parent sintered particles.

A preferred embodiment of the invention forms a composite of sintered, cobalt bound tungsten carbide particles in a steel matrix. The steel is introduced in particle form which may involve pellets, chunks, grit, shot, powder or some combination of these, and the sintered tungsten carbide employed may include some very fine powder particles but will typically and additionally employ grit or whole parts of a substantially larger size. The steel may typically be heated to a temperature of 100° to 200° F. above its melting temperature, or possibly 2800° F. Since the cobalt bound sintered material was originally formed at about 2680° F. (the practical or "normal" sintering temperature) it will begin to de-sinter when exposed to the higher temperature matrix. At the molten matrix temperature some of the binder material of the sintered tungsten carbide may dissolve into the molten steel and there will be some diffusion of the carbon and to a lesser extent the tungsten into the matrix. The dissolving of the sintered binder may release fine tungsten carbide powder particles into the matrix. The resulting composite will include sintered tungsten carbide particles of a smaller size than the original particles surrounded by zones of high carbon, high tungsten steel incorporating unsintered tungsten carbide particles of a micron size. These "diffusion zones" will be substantially harder than those areas formed by solidification of the unadulterated steel and will form a strong metallurgical bond between the steel and the remaining sintered tungsten carbide particles.

The process may be performed while the matrix and the high temperature particles are under pressure as in a hot pressing process. This process results in a higher density product.

The method of the present invention is also useful for reforming scrap or salvaged sintered materials into larger useful shapes. For example, in the manufacture of sintered carbide parts, such as cutting tools and the like, a fairly large percentage of scrap material is generated. In the past it has been necessary to treat these scrap materials chemically, mechanically or by some combination of the two in order to reduce them to fine powders which were then resintered by a process similar to that used with virgin unsintered powder. Similar expensive, time consuming processes have been used to reclaim worn sintered tungsten carbide parts such as cutting tools and the like.

Through use of the present method it is possible to reclaim scrap and salvaged sintered materials by simply crushing them into a grit of substantially larger particle size than the powders required by the previous processes and using that grit as the hard particle material in the process of the present invention. The matrix material may take the form of particles of the same binder used with the sintered particles; i.e., with a grit formed of reclaimed or scrap cobalt bound sintered tungsten carbide, cobalt may be used to form the binder material. The mass of sintered grit and cobalt is heated above the melting temperature of the cobalt. The heat may be terminated as soon as the cobalt matrix and the cobalt binder of the sintered grit have dissolved in one another or it may be continued to increase the diffusion and dissolving of the carbon and tungsten components into the cobalt, thus increasing the extent of the hardened diffusion zone.

The method of the present invention is well suited for the formation of parts that must withstand highly abrasive wear forces as well as impact forces. For example, the process may be used to form hammers of the type used in hammer mills that operate on highly abrasive parts. It is also well suited for the formation of rock bits or drills, scraper blades, slides for ores and the like, and drawing and extrusion dies. It is also useful for forming armor plating and penetration resistant security plates that can withstand drills, picks and torches, and armor piercing projectiles.

The present process may be used to produce composite structures wherein the sintered bodies are not uniformly dispersed but are concentrated in selected areas where their properties are required. For example, in forming rock bits bodies of sintered material may be selectively placed in the mold prior to heating so that in the finished composite the sintered materials will be disposed adjacent to the cutting surfaces of the bit and the supporting surfaces will be formed of unadulterated matrix material. Similarly, in armor plate the sintered grit may be localized in the forward surface so that the rear surface is free of the harder particles and is highly ductile to minimize spalling when the plate is hit by a projectile.

The size of the original sintered particles may be varied to accommodate the desired finished form of the composite. In cutting tools relatively large sections of sintered material, that may be considered inserts, are located adjacent the cutting surfaces. The remaining area may include finer size sintered particles or may be free of these particles so that relatively unadulterated matrix sections are formed. The method of the present invention thoroughly wets the inserts to the matrix metal.

Relatively fine particles of a sintered material that will be totally disintegrated during the processing may be employed to control the extent of the diffusion zone and the degree of disintegration of the larger particles. Since increases in the dissolved constituents of the sintered material within the matrix material tend to reduce the solubility of further sintered constituents in the matrix material, the addition of fine sintered particles that quickly dissolve and de-sinter in the matrix material tends to reduce the degree of degradation of the larger sintered products during the process.

The process of the present invention may be distinguished from conventional sintering processes conducted at a temperature above the melting point of one of the constituents by two factors: first, one of the components of the present process is previously sintered material, unlike conventional sintering processes wherein homogeneous components are employed. The degradation of the sintered particles during the present process proceeds by a de-sintering mechanism as well as the diffusion and solution mechanism which characterizes conventional sintering processes. For example, when the present method is practiced employing cobalt bound sintered tungsten carbide, the cobalt binder dissolves in the molten matrix at a much higher rate than do the tungsten carbide particles themselves, releasing islands of tungsten carbide into the molten matrix material. Some of these islands may totally dissolve within the matrix while the other islands remain integral, although diminished, in the final composite. In both these ways the nature of the diffusion zones surrounding the remaining sintered particles is dramatically affected.

The second critical distinction between the method of the present invention and conventional sintering lies in the use of temperatures above the disintering temperature of the sintered particles for the molten material and the resultant de-sintering during the processing. In conventional sintering the temperatures of the components are such that the flow of one of the constituents into the other occurs at only the immediate surface, so that there is no appreciable diminution in particle size during processing; the particle sizes of the particles used in the process and the final size of the particles in the sintered material are substantially identical. By contrast, in the present invention the higher temperature of the molten constituents produce rapid and appreciable degradation of the surfaces of the sintered components to completely dissolve the smaller constituents and appreciably reduce the particle size of the larger constituents.

In typical applications of the present invention the largest particles of the higher temperature material present in the mold will be degraded by about 1% to 70% in volume. Smaller particles may be totally degraded and the percentage volume of degradation will be a function of the original size of the particle.

The heated materials must be rapidly cooled to bring the temperature of the mass below the degradation temperature of the particles at the end of the process. This cooling is achieved by abruptly terminating the application of heat, as by removing the mold from a furnace, turning off the furnace, or terminating induction heating currents. At that time the mold must be supported at a temperature substantially below the degradation temperature of the particles and the melting temperature of the matrix material so that the mass will freeze. In certain embodiments of the invention this rapid cooling may be achieved with some form of quenching. The relatively short heating time and the rapid cooling after heating also distinguish the present invention from sintering processes which are characterized by relatively long heating times and relatively slow decreases in temperature after heating.

This high rate of degradation requires that the molten state be terminated before all of the sintered particles fully disintegrate. This need for controlled termination dictates the nature of the device for heat introduction in the present invention. Unlike conventional sintering processes wherein the powders are slowly raised to a sintering temperature and maintained at that temperature for a relatively long time and then allowed to slowly cool, the method of the present invention requires either that the material be rapidly moved into and out of the heating zone, as in a furnace, or that induction heating be used and terminated at an appropriate time.

The resulting composites differ from sintered materials in that the high rate of degradation of the sintered particles during the processing produces a distinct third phase in the final composite in addition to two original phases that represent the raw materials of the process. In addition to simply bonding two components as occurs in a conventional sintering process, the process of the present invention produces a third diffusion zone which represents an alloy of constituents of two initial phases.

Other objectives, advantages and applications of the present invention will be made apparent by the following detailed descriptions of several preferred embodiments of the invention.

The descriptions make reference to the accompanying drawings in which:

FIG. 1 is a perspective view, partially broken away for purposes of illustration, of a section of armor plate formed in accordance with the present invention, with certain sections schematically emphasized;

FIG. 2 is a perspective view of a rock bit formed in accordance with the present invention, with certain sections schematically emphasized;

FIG. 3 is a perspective view of a scraper for use in cleaning oil well casings formed in accordance with the present invention;

FIG. 4 is a perspective view of a cutting tool insert formed in accordance with the present invention;

FIG. 5 is a sectional view through a turbine stator vane formed in accordance with the present invention, with certain sections schematically emphasized; and FIG. 6 is a drawing of a magnified section of a composite formed by the method of the present invention.

While the process of the present invention can be practiced employing some form of expendable mold such as sand, ceramic, or synthetic resin shell mold, the method is preferably practiced using some form of reusable mold formed of graphite, molybdenum or the like.

The matrix metal employed with the present invention preferably consists of iron, nickel, or cobalt and their alloys. Composites employing lower melting temperature matrices such as copper based alloys are more readily formable employing conventional infiltration techniques. The matrix materials of the present invention include carbon alloy steels, corrosion resistant steels, precipitation hardening steels, manganese steels and other forms of nickel and cobalt based alloys for use in high temperature applications. Hereinafter the group of matrix materials consisting of iron, nickel and cobalt based alloys may be termed "iron group base alloys".

The sintered material may consist of sintered metallic carbides, borides, silicides or oxides.

EXAMPLE I

A section of armor plate, of the type illustrated in FIG. 1, may be formed in accordance with the present invention. The part, generally indicated at 10, may have a thickness of approximately ¼ inch and may be formed in any convenient size. The finished plate consists of stainless steel or manganese steel with particles or inserts of cobalt bound sintered titanium carbide 12 formed along one of the faces of the plate. The sintered particles are surrounded by diffusion zones consisting of an alloy of steel with cobalt, and to a lesser extent carbon and titanium.

To form the plate 10 a graphite mold in the shape of a plate, coated with a finely powdered sprayed refractory, is employed. One of the faces of the mold is packed with the desired amount of tungsten carbide particles. Preferably, ⅛ inch particles of irregular shape, produced by crushing scrap titanium carbide and the like in a cage mill are employed. Smaller particles in the range of 1/16 of an inch can be used with the ⅛ inch particles to increase the concentration of sintered particles at the packed surface.

The matrix material can be powdered stainless steel or manganese steel of approximately 150 mesh. The mold may be packed with this powder. Alternatively small pellets, chunks or a grit of the steel may be used.

The mold is rapidly heated by a high frequency induction coil to approximately 2900° F. The heating may be done in a neutral atmosphere to inhibit oxidation or sublimation of the graphite. In the plate of Example I the heating was continued for 95 seconds. The heating was then terminated and the part allowed to immediately cool toward room temperature.

During the heating the powder quickly melts and fills the interstices between the sintered particles and causes some dissolution of the surface of the particles. The dissolution continues until the matrix solidifies shortly after the induction heating has terminated. The amount of degradation of the sintered particles which occurs during this heating time depends upon the size of the individual particles, but approximately 15% of the volume of an ⅛ inch particle, fully surrounded by the matrix, may be removed during the heating.

The resultant plate may be further processed, for aesthetic and dimensional purposes, by placing additional powdered matrix material over the sintered packed face, and passing the plate through a furnace for a sufficient time to melt the powder and cause it to form a uniform coat over the face containing the sintered material (the attack side).

The finished plate has a hardness and resistance to projectile penetration on the attack side. The ductility of the attack side is higher than that of the sintered material alone and minimizes crack formation and propogation to ballistic impact.

The highly ductile rear face of the plate readily deforms upon projectile penetration of the attack side to prevent spalling.

EXAMPLE II

The process of the present invention may be employed to form a rock bit or drill head of the type illustrated at 20, in FIG. 2, for use in drilling through soil and rock. The bit has a threaded hub 22 which is adapted to be engaged to a rotating shaft. One of the four cutting edges of the bit 24 is illustrated in FIG. 2. The graphite mold is designed to provide a solid hub section. The mold is designed with a hub extension that is longer than the desired finished hub. This extension is filled with an excess of powdered material to act as a reservoir to compensate for the filling of the interstices of the packing material during melting and to compensate for the shrinkage which occurs when the molten material solidifies.

The mold is preferably formed of graphite and is coated with a fine powdered zirconium or chromium oxide refractory material.

The section of the mold corresponding to the cutting edge of the finished bit (the section 26 in FIG. 2) is lined with ¼ inch steel grade cobalt bound sintered tungsten carbide particles. Particles of 1/16 inch mesh size are placed above the quarter inch particles. The mold is then filled with a powder of alloy or meraging steel 1/16 inch to 150 mesh. The mold is placed in a high frequency induction coil and heated to approximately 2900° F. After 35 seconds at this temperature the heat cycle is discontinued and the molten part allowed to cool to room temperature. The heating time will depend on the exact configuration of the part and the packing of the particles but will continue until 10–20% of the larger sintered particles have been degraded.

The controlled degradation of the larger sintered particles, as well as the solution of the smaller particles into the steel, results in a smoother cutting edge. The sintered particles are metallurgically bonded in the composite and do not separate under drilling forces. After appropriate heat treatment to obtain a tensile strength of 200,000 to 300,000 psi, the cutting edge will have areas of hardness in the range of Rockwell C 70 to 90. The random location of the larger sintered particles prevents occurrence of a regular wear pattern during drilling and contributes to improved rock bit life.

Alternatively, buttons of sintered tungsten carbide could be substituted for the sintered particles used to line the mold. These buttons would then form the cutting edge in the finished bit. During the heating process only the surfaces of the buttons which are in contact with the molten matrix will be degraded and the surfaces of the buttons which are not exposed to the matrix will maintain their original configuration.

EXAMPLE III

A casing scraper 30 for use in cleaning oil well casings is illustrated in FIG. 3. These casing scrapers are spring loaded within a casing to force scraping edges 32 to conform to the inside diameter of the casing. The scraper 30 has four complete scraping surfaces 12 and one thin "lead in" scraping edge 34. Holes 36 are provided for positioning of the springs.

The scraper assembly is processed employing a molybdenum alloy mold to permit the composite removal without mold damage. The form of the casing scraper is formed in a molybdenum blank or block and the finished die is coated with a complex silicide to resist oxidation at the processing temperature.

The mold is packed with ¼ inch to ⅛ inch cobalt bound sintered tungsten carbide particles at the surfaces where the segments 32 are to be formed. 3/32 inch sintered particles together with 40 mesh particles are placed at the location of the lead-in edge 34. The mold is filled with 50 to 325 SAE 4340.

The mold is heated in an atmosphere controlled continuous furnace with a high temperature zone of 2800° to 2950° F. for one to five minutes. The time may be experimentally determined to obtain optimum properties in the finished composite. Cooling is in air or in an atmosphere controlled cooling zone in the furnace.

The composite casing scraper is removed from the mold and heat treated by oil quenching and tempering to produce the required properties.

The controlled deterioration of the sintered particles on the four large scraping surfaces 32 produces an effective abrasion resistant scraping surface. This surface extends to the edges of the cutting surface and extends scraper life. The deterioration of sintered particles at the thin section 32 produces a relatively ductile wear resistant surface not attackable by conventional materials or composite systems.

EXAMPLE IV

The method of the present invention may be employed to form cutting tool inserts of the type generally illustrated at 40 in FIG. 4. The inserts are of the type used with cutters for lathes, milling machines and the like. The finished insert is generally rectangular in shape with a cutting surface 42 characterized by sections of sintered tungsten carbide disposed in a matrix 44 formed of steel.

The cutters 40 are formed employing either small individual molds or multi-cavity molds formed of graphite. Sintered tungsten carbide particles of ⅛ inch size together with 100 mesh sintered carbide particles are placed on the cutting surface. The balance of the mold is filled with powder of 50 to 100 mesh size SAE 4340 or 5% chromium alloy steel.

The mold is induction heated to approximately 2850° F. and retained at this temperature for about three minutes, or until approximately 20% of the larger sintered particles have degraded into the molten steel. This size reduction in the finished part may be confirmed by radiographic metallographic examination of the composite.

The composite cutting tool insert has an excellent metal machining capability and is not subject to chipping or breaking when shock loaded or during interrupted machining cuts. This is attribute to the comparatively ductile interfacing material between sintered particles resulting from their controlled degradation and solution into the steel. The original hardness of the remaining larger sintered particles is not reduced by the process.

EXAMPLE V

A section through a jet engine turbine stator vane, generally indicated at 50, is illustrated in FIG. 5. The stator vane, formed of a composite and made in accordance with the present invention, is located after the engine combustors. The temperature at this point in the engine can exceed 2000° F. The life of the turbine stator vanes is limited by thermal shock cracking, erosion, oxidation and sulfidation (in certain fuels) and sea salt (in sea water environments). Prior art materials for use in these stator blades were a compromise in material properties, fabrication methods and service life. Complex systems of cooling are used to achieve structural or performance design criteria.

The vane 50 is formed by employing a molybdenum mold. Small holes are drilled in the upper half of the mold for purging of air from the composite and for atmosphere control as required during processing. The mold is coated with silicide for oxidation resistance.

The mold areas corresponding to the leading edge of the vane are packed with 3/16 inch to 100 mesh sintered tungsten carbide particles. The balance of the mold is packed with a high temperature alloy composite; preferably a cobalt based alloy. The steel is packed in the attachment area 52 as well as in the air foil area 54. The mold temperature is raised approximately 100° above the melting temperature of the steel employing an induction heating coil. The heating continues until approximately 15% of the larger sintered particles have been degraded and then is abruptly terminated, allowing the molten mass to immediately cool toward room temperature. Pressure is applied to the molybdenum mold in the range of 20 to 300 psi during processing. This assures the complete filling of the interstices between the phases and high dimensional accuracy. Pressure is reduced one to 30 minutes after termination of the heating.

FIG. 6 is a schematic diagram representative of a section of composite formed in accordance with the present invention. The section represents a composite having one area containing sintered particles in sufficient proximity to one another that the resulting diffusion zones form a continuous matrix for the particles, and another area of the mold sufficiently devoid of sintered particles so that the character of the composite is essentially that of the matrix metal.

The sintered particles remaining in the finished composite have a hardness of Rockwell C 78. The matrix which surrounds them appears to have three regions with hardness of Rockwell C 70, Rockwell C 60 and Rockwell C 40. These areas merge to form a continuous diffusion zone. The basic matrix metal is indicated at the lower left and has a hardness of 30 measured on the Rockwell B Scale.

The embodiments of the invention in which an exclusive property or privilege is claimed are defined as follows:

1. The method of forming a composite material having sintered metal-ceramic bodies of a first, relatively small, average particle size supported in a matrix of an iron group base alloy, comprising: supporting a plurality of said sintered particles of a second, relatively large, size, in contact with particles of said matrix material to form a mass; applying heat to said mass so as to raise the temperature of at least some of the matrix particles above the melting temperature of the matrix material and above the original normal sintering temperature of the sintered particles to cause partial degradation of the sintered particles into solution with the molten matrix material; and cooling the mass below the solidification temperature of the matrix material when the sintered particles have been reduced in size to said first particle size, whereby a composite material is produced consisting of sintered particles of the first average size surrounded by zones of a combination of the matrix material and dissolved constituents of the sintered material.

2. The method of claim 1 wherein the sintered particles are formed of a sintered metallic carbide.

3. The method of claim 1 wherein the sintered particles are sintered tungsten carbide.

4. The method of claim 1 wherein the matrix material is steel.

5. The method of claim 1 wherein the mass is heated by inducing high frequency electric currents in the mass.

6. The method of claim 5 wherein the second particle size, the matrix particle size and the frequency of the electric current are such as to control the first particle size.

7. The method of claim 1 in which the mass is cooled by supporting it in a reduced temperature environment and terminating the application of heat.

8. The method of claim 1 in which the particles of the matrix material in the mass are in powder form.

9. The method of forming a composite material containing sintered bodies of a first average particle size surrounded by zones formed of the solution of the body material in an iron group material matrix, comprising: forming a mass of sintered bodies of a second particle size which is larger than said first particle size and particles of the matrix material, with portions of the surfaces of the sintered bodies in contact with the matrix material; introducing thermal energy into the mass to raise the temperature of the matrix material above its melting temperature and above the original normal sintering temperature of the sintered bodies to cause wetting of the surfaces of the sintered bodies contacted by the matrix material and dissolving and diffusion of the surfaces of the contacted sintered bodies into the matrix material; and cooling the mass to produce solidification when the sintered bodies have been degraded to said first particle size by disintegration, solution and diffusion.

10. The method of claim 9 wherein the bodies consist of a sintered metallic-ceramic.

11. The method of claim 9 wherein introduction of thermal energy is terminated when between about 1% to 70% of the larger bodies become degradated in the molten matrix.

12. The method of claim 11 wherein the bodies are formed of a sintered metal-ceramic.

13. The method of claim 12 wherein the bodies are sintered tungsten carbide.

14. The method of claim 13 wherein the matrix material is steel.

15. The method of claim 9 wherein the thermal energy is introduced by electrical induction heating.

16. The method of claim 9 wherein the thermal energy is introduced by moving the mass through a furnace.

17. The method of claim 9 wherein the bodies are sintered metallic-carbide, the matrix is steel, and the steel is heated to a temperature between 2650° and 3200° F.

18. The method of claim 9 wherein the mass is supported in an electrically conductive mold.

19. The method of forming a composite material containing sintered bodies surrounded by zones formed of the solution of the body material of an iron group alloy matrix, comprising: forming a mass of particles of the matrix material and sintered bodies with only portions of the surfaces of the sintered bodies in contact with the matrix material and the balance of the portions of the surfaces of the sintered bodies forming boundaries of the mass; introducing thermal energy into the mass to raise the temperature of the matrix material above its melting temperature and above the original normal sintering temperature of the sintered bodies to cause wetting of the surfaces of the sintered bodies contacted by the matrix material and dissolving and diffusion of the surfaces of the contacted sintered bodies into the matrix material; and cooling the mass to produce solidification; whereby only those surfaces of the sintered bodies which are contacted by the matrix material are degraded.

* * * * *